US009087493B2

(12) United States Patent
Jung et al.

(10) Patent No.: US 9,087,493 B2
(45) Date of Patent: Jul. 21, 2015

(54) LIQUID CRYSTAL DISPLAY DEVICE AND DRIVING METHOD THEREOF

(75) Inventors: Yong-Chae Jung, Daegu (KR); Min-Hwa Kim, Gumi (KR)

(73) Assignee: LG Display Co., Ltd., Seoul (KR)

( * ) Notice: Subject to any disclaimer, the term of this patent is extended or adjusted under 35 U.S.C. 154(b) by 1689 days.

(21) Appl. No.: 11/945,669

(22) Filed: Nov. 27, 2007

(65) Prior Publication Data

US 2008/0211790 A1 Sep. 4, 2008

(30) Foreign Application Priority Data

Dec. 1, 2006 (KR) ..... 10-2006-0120896
Nov. 23, 2007 (KR) ..... 10-2007-0120505

(51) Int. Cl.
*G09G 3/36* (2006.01)
*G09G 3/32* (2006.01)

(52) U.S. Cl.
CPC ..... *G09G 3/3688* (2013.01); *G09G 3/3266* (2013.01); *G09G 2320/0214* (2013.01)

(58) Field of Classification Search
CPC ..... H03K 17/00; H02H 3/00
USPC ..... 345/98–100, 204, 690
See application file for complete search history.

(56) References Cited

U.S. PATENT DOCUMENTS 7,522,148 B2 * 4/2009 Maki ..... 345/100
7,924,274 B2 * 4/2011 Guttag ..... 345/204
8,004,505 B2 * 8/2011 Guttag ..... 345/204
2001/0043201 A1 * 11/2001 Taguchi et al. ..... 345/204
2003/0151616 A1 * 8/2003 Morita ..... 345/690
2004/0100435 A1 * 5/2004 Baek et al. ..... 345/98
2004/0189627 A1 * 9/2004 Shirasaki et al. ..... 345/204

(Continued)

FOREIGN PATENT DOCUMENTS

KR 10-2003-0074316 A 9/2003
KR 1020040045080 A 6/2004

(Continued)

OTHER PUBLICATIONS

Office Action issued in corresponding Korean Patent Application No. 10-2007-0120505, mailed Dec. 31, 2013, 5 pages.

(Continued)

*Primary Examiner* — William Boddie
*Assistant Examiner* — Jeffrey A Parker
(74) *Attorney, Agent, or Firm* — Brinks Gilson & Lione

(57) ABSTRACT

A liquid crystal display device includes a liquid crystal panel, a gate driver, a data driver, and an initial driving control unit. The liquid crystal panel includes a plurality of liquid crystal cells. Each liquid crystal cell is defined by a gate line, a data line and a thin film transistor. The gate driver controls the thin film transistor connected to the gate line of each liquid crystal cell according to a gate control signal. The data driver outputs a pixel signal to the data line of the each liquid crystal cell according to a data control signal. The data driver includes a switch connected to the data line of the each liquid crystal cell. The initial driving control unit is structured to compare a clock count with a predetermined reference value and operable to alternately generate a first state signal and a second state signal based on the comparison. The unit applies the first state signal to the switch during a masking interval. The pixel signal is not output to the data line during the masking interval.

18 Claims, 8 Drawing Sheets

(56) References Cited

U.S. PATENT DOCUMENTS

2004/0263466 A1* 12/2004 Song et al. ..... 345/100
2008/0278427 A1* 11/2008 Jang et al. ..... 345/98

FOREIGN PATENT DOCUMENTS

KR 10-2004-0079047 A 9/2004
KR 10-2006-0050818 A 5/2006

OTHER PUBLICATIONS

Office Action issued in Korean Patent Application No. 10-2007-0120505, mailed Oct. 28, 2014, 4 pages.
Notice of Allowance dated May 27, 2015 for corresponding Korean Patent Application No. 10-2007-0120505, 2 pages.

* cited by examiner

LIQUID CRYSTAL DISPLAY DEVICE AND DRIVING METHOD THEREOF

PRIORITY CLAIM

The application claims the benefits of Korean Patent Application No. 2006-120896 filed in Korea on Dec. 1, 2006, and Korean Patent Application No. 10-2007-0120505 filed in Korea on Nov. 23, 2007, which is hereby incorporated by reference.

BACKGROUND

1. Field of the Invention

The present invention relates to a liquid crystal display device and a driving method thereof, and more particularly to a liquid crystal display device and a driving method thereof which prevents an abnormal phenomenon on a screen.

2. Description of the Related Art

Mobile information devices include flat panel display devices because they are light weight with minimal thickness. In particular, a liquid crystal display device is actively used in a notebook, a monitor of a desktop computer, a television, and the like. The liquid crystal display device displays images by using an optical anisotropy of a liquid crystal and provides good performance in resolution, color display, and image quality.

FIG. 1 shows a liquid crystal display device 50 which includes a liquid crystal panel 2, a gate driver 4, a data driver 6 and a timing controller 10. The liquid crystal panel 2 arranges a plurality of liquid crystal cells in a matrix shape defined by a plurality of gate lines GL1-GLn and a plurality of data lines DL1-DLm. The gate driver 4 applies gate scan signals to the gate lines GL1-GLn of the liquid crystal panel 2. The data driver 6 applies pixel signals to the data lines DL1-DLm of the liquid crystal panel 2. The timing controller 10 controls the gate driver 4 and the data driver 6.

The liquid crystal panel 2 includes a plurality of the liquid crystal cells which are defined by a plurality of the gate lines GL1-GLn and a plurality of the data lines DL1-DLm, and thin film transistors (TFTs). The TFTs are formed in each of the liquid crystal cells and are connected to the gate lines GL1-GLn and the data lines DL1-DLm.

When a scan signal, for instance, a gate high voltage (Vgh) is provided from the gate lines GL1-GLn, the TFTs are turned on and provide pixel signals applied from the data lines DL1-DLm to the liquid crystal cells. On the other hand, when a gate low voltage (Vg1) is provided from the gate lines GL1-GLn, the TFTs are turned off and maintain the pixel signals charged in the liquid crystal cells.

Each liquid crystal cell is associated with a pixel electrode and a common electrode facing each other. The pixel electrode is connected to a TFT and stores a pixel signal, thereby forming a liquid crystal capacitor Clc. In addition, a storage capacitor Cst is formed in the liquid crystal cell to maintain the pixel signal in a stable manner until the next pixel signal is charged after one pixel signal is charged. With such a configuration, the liquid crystal display device 50 may change an array state of liquid crystal molecules having dielectric anisotropy according to the pixel signals inputted through the TFTs, and may implement a gradation by adjusting the light transmissivity according to the array state of the liquid crystal molecules.

As the timing controller 10 sends gate control signals, the gate driver 4 sequentially outputs gate high voltages (Vgh) to the gate lines GL1-GLn and drives each of the TFTs connected to the gate lines GL1-GLn. As the timing controller 10 sends data control signals, the data driver 6 outputs pixel signals to the data lines DL1-DLm. The data driver 6 converts digital signals of R, G, and B provided by the timing controller 10 into analog pixel signals, and then provides the converted signals to the data lines DL1-DLm.

The TFTs are turned on for a determined period of time upon application of the gate high voltages Vgh. In a state that the TFTs are turned on, the pixel signals in the data driver 6 are applied to the data lines DL1-DLm through the TFTs.

At the time of the initial driving of the liquid crystal display device 50, the TFTs may not be completed turned off for a short period of time. The tail of the waveforms may keep the TFTs turned on before the TFTs are completely turned off. A certain initial data, which is arbitrarily set by driver manufacturers, may be provided to the data lines DL1-DLm. The initial data are further applied to the liquid crystal cells and a screen displays an image corresponding to the initial data. Upon application of a picture signal of a gradation voltage, the prolonged on-state of the TFTs may affect a screen quality. A stripe, which is visually recognizable, may occur on the screen for a short time. Therefore, there is a need for a liquid crystal display device that overcomes such drawback of the related art.

SUMMARY

By way of example, in one embodiment, a method for driving a liquid crystal display device operable to display a picture represented at least by gradation voltage data using a liquid crystal panel is provided. In the method, a gate control signal is supplied to control a gate driver. A data control signal is supplied to control a data driver. A source output enable ("SOE") signal is generated. The SOE signal enables transfer of the gradation voltage data corresponding to a first horizontal line from the data driver to the liquid crystal panel. The gradation voltage data is not output from the data driver during the masking interval according to the SOE masking signal. The gradation voltage data is output to the liquid crystal panel other than the masking interval.

In other embodiment, a liquid crystal display device includes a liquid crystal panel, a timing controller, a gate driver and a data driver. The liquid crystal panel includes a plurality of liquid crystal cells. Each liquid crystal cell is defined by a gate line and a data line. The timing controller generates a gate control signal, a data control signal and a source output enable ("SOE") signal. The timing controller also generates a source output enable ("SOE") masking signal based on the SOE signal for a predetermined masking interval. The SOE signal enables transfer of a pixel data to the data line, and the SOE masking signal inhibits transfer of the pixel signal to the data line. The gate driver controls the thin film transistor connected to the gate line of each liquid crystal cell according to the gate control signal. The data driver outputs a pixel signal to the data line of the each liquid crystal cell according to the data control signal. The data driver does not output the pixel signal during the masking interval.

In another embodiment, a liquid crystal display device includes a liquid crystal panel, a gate driver, a data driver, and an initial driving control unit. The liquid crystal panel includes a plurality of liquid crystal cells. Each liquid crystal cell is defined by a gate line, a data line and a thin film transistor. The gate driver controls the thin film transistor connected to the gate line of each liquid crystal cell according to a gate control signal. The data driver outputs a pixel signal to the data line of the each liquid crystal cell according to a data control signal. The data driver includes a switch connected to the data line of the each liquid crystal cell. The initial driving control unit is structured to compare a clock count with a predetermined reference value and operable to alternately generate a first state signal and a second state signal based on the comparison. The unit applies the first state signal to the switch during a masking interval. The pixel signal is not output to the data line during the masking interval.

The foregoing and other objects, features, aspects and advantages of the present invention will become more apparent from the following detailed description when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS AND DRAWINGS

Reference will now be made in detail of a liquid crystal display device according to the preferred embodiments of the present disclosure, examples of which are illustrated in the accompanying drawings.

Figure 1:
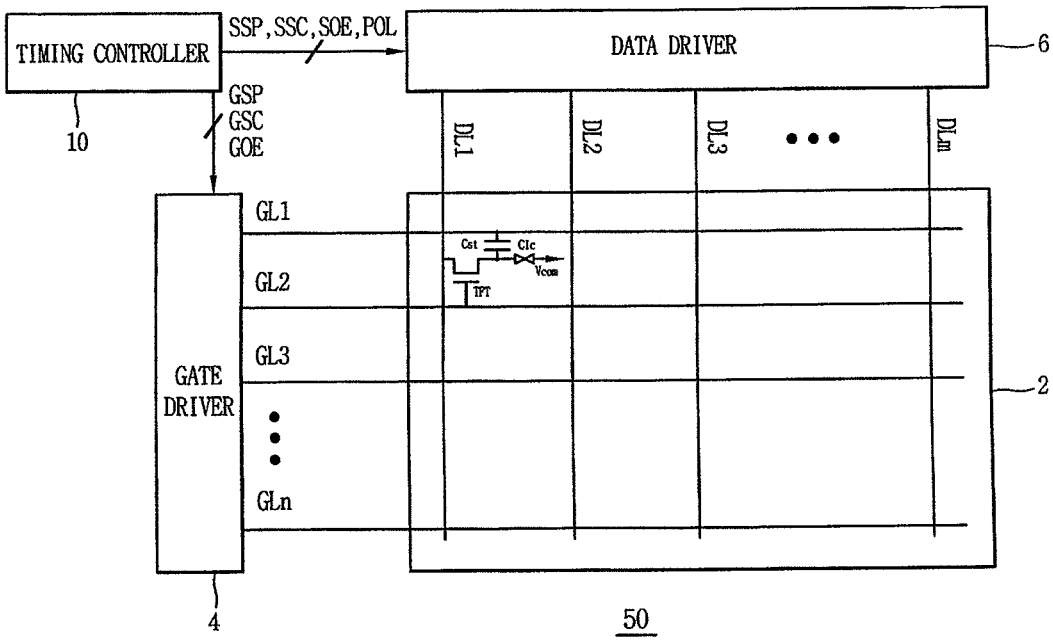
FIG. 1 RELATED ART
FIG. 1 is a block diagram showing a related art liquid crystal display device.
Figure 2:
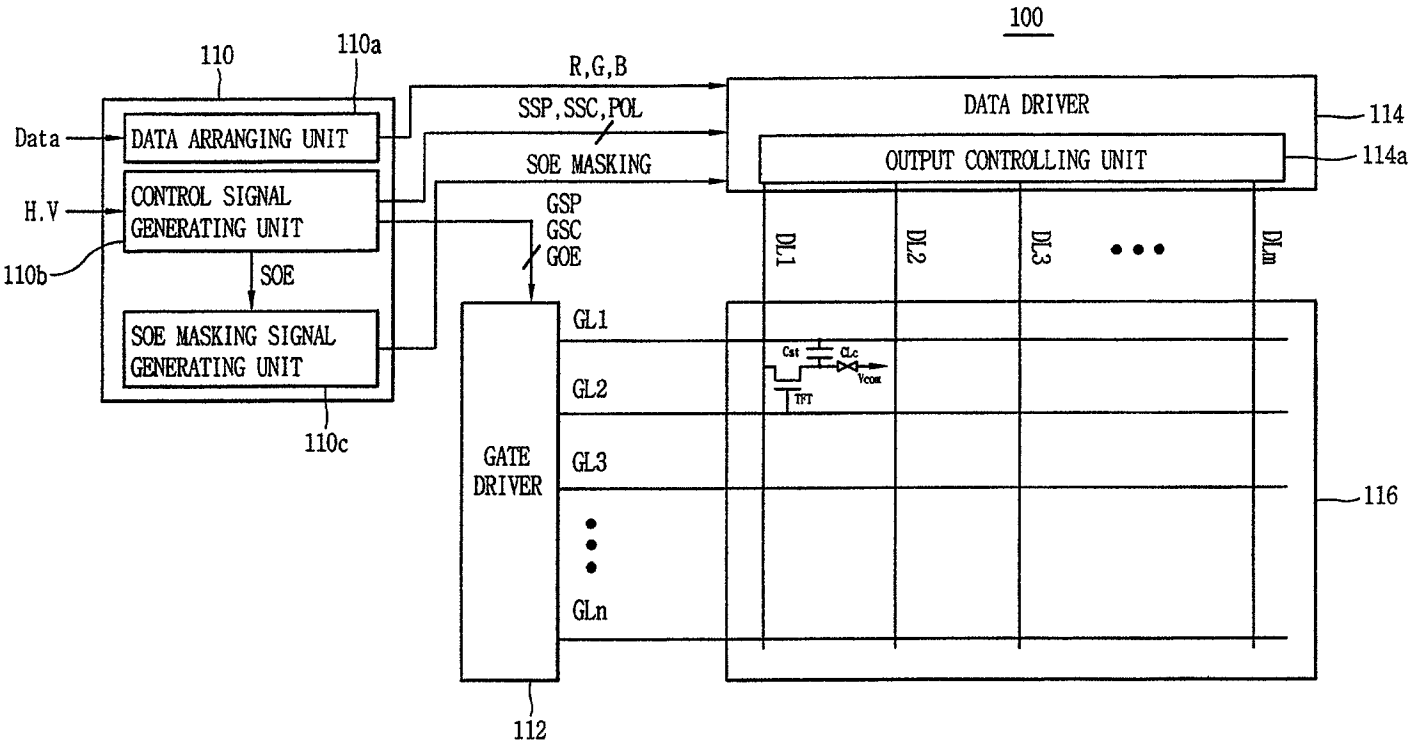
FIG. 2 is a block diagram showing one embodiment of a liquid crystal display device.

FIG. 2 is a block diagram showing one embodiment of a liquid crystal display (LCD) device 100. In particular, FIG. 2 illustrates a driving unit of the liquid crystal display device 100. In FIG. 2, the liquid crystal display device 100 includes a timing controller 110, a gate driver 112, a data driver 114 and a liquid crystal panel 116. The gate driver 112 and the data driver 114 operate to output a gate signal and a pixel signal according to a signal applied from the timing controller 110, respectively. The liquid crystal panel 116 receives the signals output from the gate driver 112 and the data driver 114.

The liquid crystal panel 116 arranges a plurality of liquid crystal cells in a matrix shape, which are defined by a plurality of gate lines GL1-GLn and a plurality of data lines DL1-DLm. Thin film transistors (TFTs) are formed in each of the liquid crystal cells.

The timing controller 110 includes a data arranging unit 110*a*, a control signal generating unit 110*b* and a source output enable ("SOE") control signal generating unit 110*c*. The data arranging unit 110*a* aligns video data which is input through a graphic card in a system driver (not shown). The control signal generating unit 110*b* generates a control signal, such as a timing signal for controlling a timing of the gate driver 112 and the data driver 114 according to a signal from the graphic card. The control signal generating unit 110*b* also generates and provides an SOE signal to the SOE control signal generating unit 110*c*. The SOE control signal generating unit 110*c* generates a SOE control signal which includes the SOE signal and an SOE masking signal. The SOE masking signal is generated by using the SOE signal and operates to mask the SOE signal for a predetermined time interval.

The liquid crystal display device 100 is connected to a system such as mobile information devices, notebooks, desktop computers, televisions, etc. A graphic card in a system driver converts an input video data according to a resolution of the liquid crystal display device 100, and then outputs the converted data to the liquid crystal display device 100. The video data includes data of red R, green G, and blue B. In addition, the graphic card generates a control signal, such as a clock signal (DCLK), a horizontal synchronization signal (Hsync), a vertical synchronization signal, and the like.

The timing controller 110 aligns the video data converted by the graphic card in the data arranging unit 110*a*, and then supplies the data to the data driver 114. The control signal generating unit 110*b* generates a gate control signal and a data control signal to control the timing of the gate driver 112 and the data driver 114 according to the control signal of the graphic card.

The gate control signal includes a gate shift clock (GSC), a gate output enable (GOE), a gate start pulse (GSP), etc. The gate shift clock (GSC) is a signal that determines when to turn on or off a gate of a thin film transistor. The gate output enable (GOE) is a signal that controls an output of the gate driver 112, and the gate start pulse (GSP) is a signal that marks a first driving line on a screen of one vertical synchronization signal.

The data control signal includes a source sampling clock (SSC), a source output enable (SOE), a source start pulse (SSP), a polarity reverse (POL), a data reverse (REV), an odd/even data signal, etc. The source sampling clock (SSC) is used as a sampling clock for latching data in the data driver 114, and determines a driving frequency of the data drive IC. The source output enable (SOE) concurrently enables transfer of data corresponding to a first horizontal line latched by the SSC to the liquid crystal panel 116. The source start pulse (SSP) is a signal that instructs the initiation of the data latch or sampling during a first horizontal synchronization interval. The polarity reverse (POL) is a polarity signal that inverts the polarity of a liquid crystal into a positive or a negative polarity upon liquid crystal inversion driving. The data reverse (REV) selects a polarity of a transmitted data. The odd/even data signal indicates odd number data of an odd-numbered pixel and even number data of an even-numbered pixel.

As noted above, the SOE control signal generating unit 110*c* generates the SOE masking signal. The SOE masking signal is a signal that has a masking interval for a predetermined time upon initial driving of the liquid crystal display device 100. The SOE masking signal inhibits gradation voltage data from being sent to the liquid crystal panel 116. Thus, during the masking interval, the data driver 114 does not output the gradation voltage data to the liquid crystal panel 116. As shown in FIG. 2, the SOE control signal generating unit 110*c* resides in the timing controller 110 along with the data arranging unit 110*a* and the control signal generating unit 110*b*. Alternatively, the SOE control signal generating unit 110*c* may be formed separate from the timing controller 110. In another embodiment, the data arranging unit 110*a* and/or the control signal generating unit 110*b* may be separate from the timing controller 110.

The data driver 114 provides an analog picture signal to a corresponding liquid crystal cell through thin film transistors. The thin film transistors are arranged on the liquid crystal panel 116. Gate terminals of the thin film transistors are turned on/off line by line in response to the control signals input from the timing controller 110. The data driver 114 samples video data R, G, and B input from the timing controller 110, latches the sampled data and then converts the data stored in the latch into the gradation voltage. The data driver 114 provides the gradation voltage to the liquid crystal panel 116.

Figure 3:
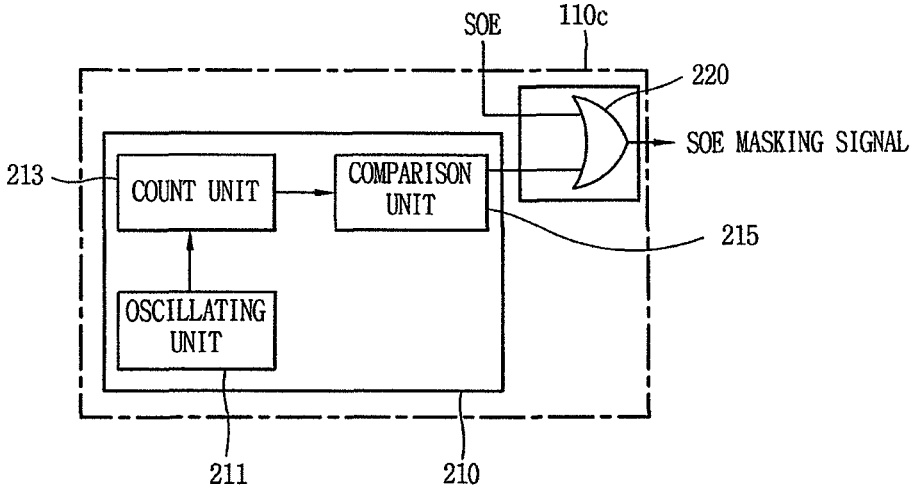
FIG. 3 is a block diagram showing the structure of a source output enable ("SOE") control signal generating unit of FIG. 2.
Figure 4:
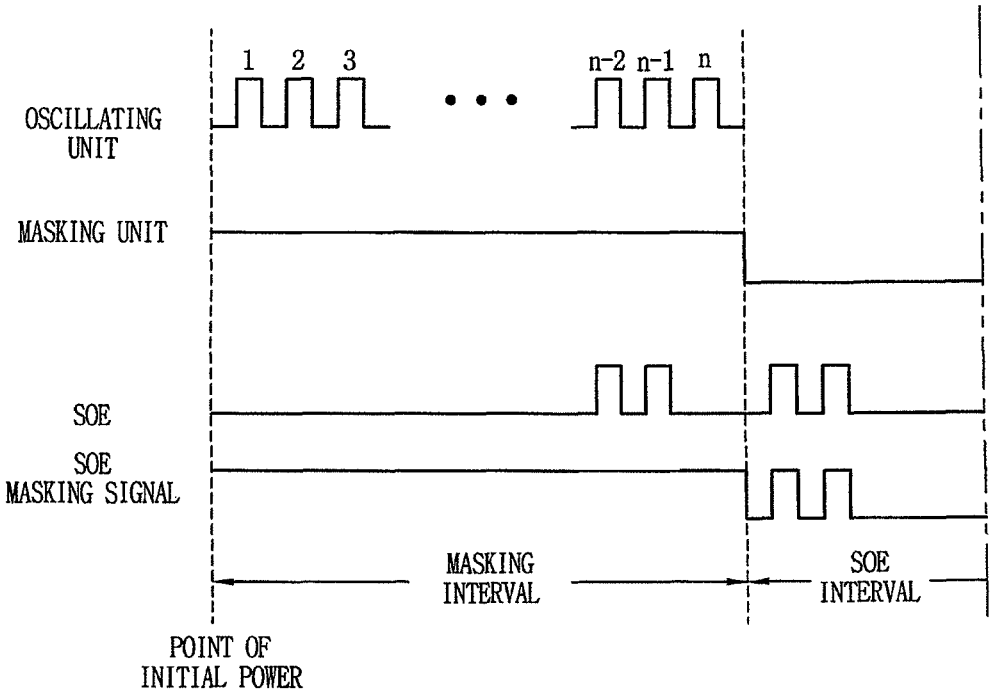
FIG. 4 illustrates waveforms showing operations of the SOE control signal generating unit of FIG. 3.

Referring to FIGS. 3 and 4, configuration and operation of the SOE control signal generating unit 110*c* are described in detail. In FIG. 3, the SOE control signal generating unit 110*c* includes a masking signal generating unit 210 and an operator 220 having an OR gate. In addition, the masking signal generating unit 210 includes an oscillating unit 211, a count unit 213, and a comparison unit 215. The oscillating unit 211 generates clocks having a certain period. The count unit 213 operates to count the clocks generated from the oscillating unit 211 and periodically inverts the clocks. Based on the clock count from the count unit 213, the comparison unit 215 determines a high-state and a low-state of the SOE masking signal. For instance, the comparison unit 215 determines the period of the high-state and outputs it to the operator 220 upon determination that the clock count is less than a reference value. Specifically, the high state lasts while the clock count is less than the reference clock count. When the clock count exceeds the reference clock count, the high state is converted to the low-state.

The generation of the SOE masking signal is explained further in reference to the waveform shown in FIG. 4. FIG. 4 illustrates one example of the SOE masking signal having a particular frequency. Various waveforms and frequency ranges are available to the SOE masking signal. In FIG. 4, an oscillation signal of 100 kHz is generated in the oscillating unit 211, and the count unit 213 is synchronized at the initial driving time of the liquid crystal display device 100. Subsequently, the count unit 213 inverts a signal every time (n=500) corresponding to the initial 5 ms. Likewise, the comparison unit 215 sets a reference value corresponding to 5 ms. The comparison unit 215 determines how long the SOE masking signal maintains the high state by comparing the number of clocks counted by the count unit 213 and the initial reference value. Alternatively, the SOE masking signal becomes a low state when the number of clocks counted by the count unit 213 exceeds the reference value. In other words, when the clocks counted by the count unit 213 are less than the reference clock, e.g., 500, the SOE masking signal maintains the high-state; on the other hand, when the clocks counted by the count unit 213 exceeds the reference clock, the SOE masking signal becomes the low-state.

Referring back to FIG. 3, the operator 220 is formed with the OR gate and generates the SOE control signal by performing a "OR" logic operation for the SOE signal from the control signal generating unit 110*b* and the SOE masking signal from the masking signal generating unit 210. Accordingly, during the initial driving period, the SOE masking signal is present and after the initial driving period, the SOE signal follows the SOE masking signal.

Figure 5A:
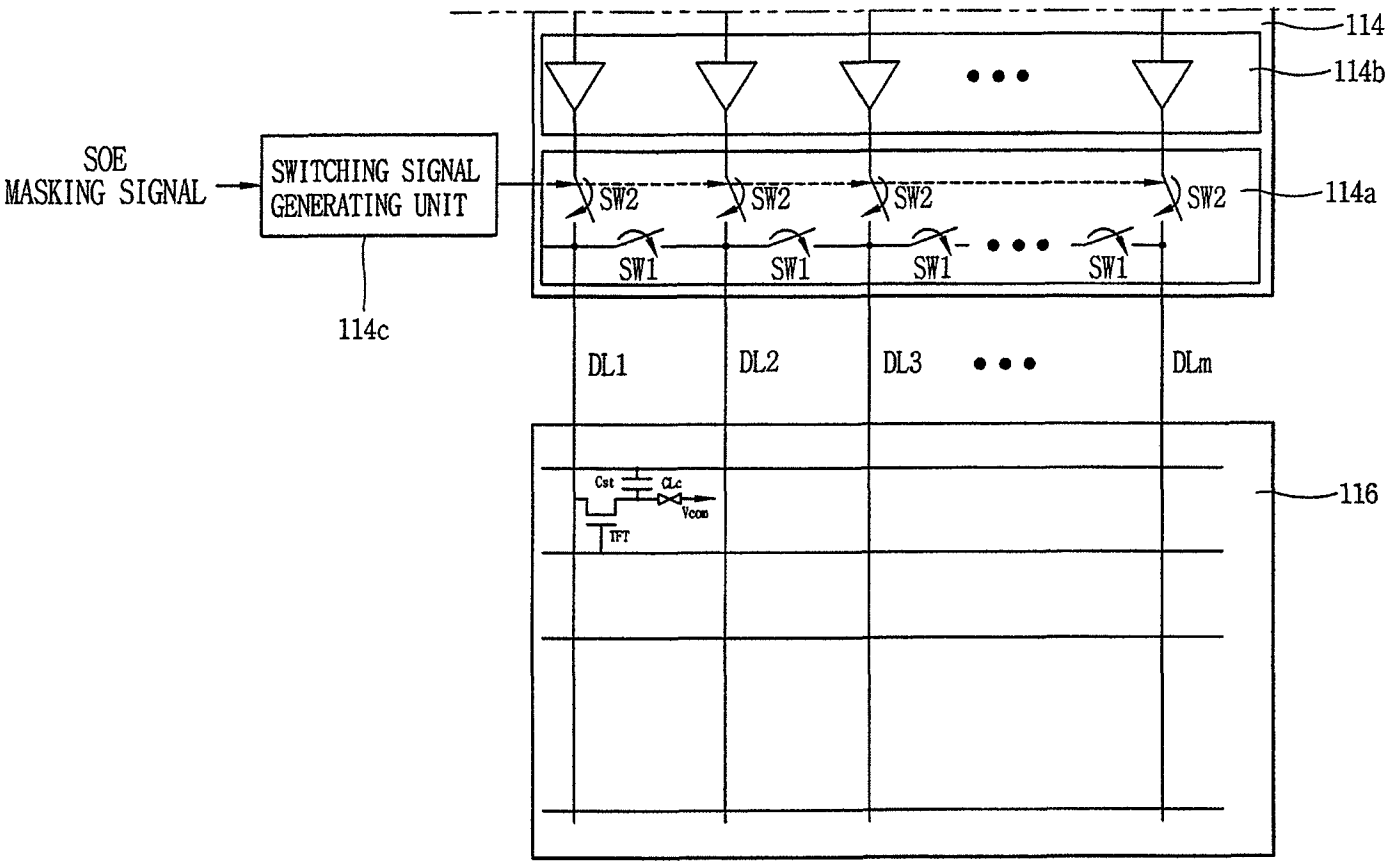
FIG. 5A is a diagram showing a data driver and a liquid crystal panel used in the liquid crystal display device of FIG. 2.

The SOE control signal is applied to the data driver 116, as shown in FIG. 2. FIG. 5A shows the structure of the data driver 114 in connection with the SOE control signal. The data driver 114 includes an output controlling unit 114*a*, a buffer 114*b*, and a switching signal generating unit 114*c*. In this embodiment, the data driver 114 includes the buffer 114*a*, the output controlling unit 114*b*, and the switching signal generating unit 114*c*. In other embodiment, the timing controller 110 of FIG. 2 may include the switching signal generating unit 114*c*.

The output controlling unit 114*a* includes a first switch SW1 and a second switch SW2. The first switch SW1 includes a plurality of switches which extend in parallel to the gate lines. The second switch SW2 includes a plurality of switches which is connected to the data lines. The second switch SW2 is controlled in response to the SOE control signal, more specifically, the SOE masking signal.

Additionally, the data driver 114 includes a data register for storing RGB data from the timing controller 110, a shift register for generating a sampling clock, a first latch and a second latch connected between the shift register and them data lines DL1-DLm. The data driver 114 further includes a gamma gradation voltage circuit for dividing gamma reference voltages and providing the divided gamma voltages to a digital/analog converter (DAC). The data register temporarily stores RGB data input from the timing controller 110 and then provides the stored data RGB to the first latch. The shift register generates a sampling signal by shifting the source start pulse (SSP) from the timing controller 110 according to the source sampling clock (SSC). In addition, the shift register transfers a carrier signal (CAR) to a shift register of the next line by shifting the source start pulse (SSP). The first latch samples a digital video data (RGB) from the data register in response to the sampling signal sequentially from the shift register, and latches the sampled digital video data (RGB) line by line. The second latch operate to latch the digital data RGB from the first latch, and then simultaneously outputs the latched digital video data (RGB) to the data lines in response to the SOE masking signal from the timing controller 110. The gamma gradation voltage circuit uses a voltage from an external power/voltage generator to re-divide the gamma reference voltages divided by a reference voltage generator (not shown), and to generate gamma gradation voltages corresponding to each gradation.

In response to the video data RGB from the second latch, the DAC selects and outputs a gradation voltage of a corresponding level that is provided by the gamma gradation voltage circuit. The gradation voltage outputs a voltage having either a positive or a negative polarity according to the polarity control signal (POL) outputted from the timing controller 110.

An output circuit includes the output controlling circuit 114*a* and the buffer 114*b*. The output circuit temporarily stores into the buffer analog pixel voltages R, G, and B which are selected and outputted from the DAC. As noted above, the output controlling unit 114*a* includes the first and the second switches SW1 and SW2 communicating with the buffer 114*b*. The output controlling unit 114*a* controls the first and the second switches SW1 and SW2 by applying the SOE masking signal to the second latch during the initial driving period. As a result, data may not be output to the liquid crystal panel 116 at the time of the initial driving of the liquid crystal display device 100.

During the initial driving period, the SOE masking signal is applied to the output controlling unit 114*a* through the buffer 114*b* of the data driver 114. As shown in FIG. 5A, the switching signal generating unit 114*c* also outputs a switching signal for controlling the first switch SW1 and the second switch SW2 of the output controlling unit 114*a* in response to the SOE control signal.

At the time of the initial driving of the liquid crystal display device 100, the SOE signal is masked by the SOE masking signal and the second switch SW2 is turned off in response to the SOE masking signal. Initial data, if any, may not be output to the data lines DL1-DLm. After the initial driving period, the SOE signal is provided in a regular sequence and the second switch SW2 is turned on. A picture signal having an effective picture voltage is inputted to a pixel of the liquid crystal display device 100.

Figure 5B:
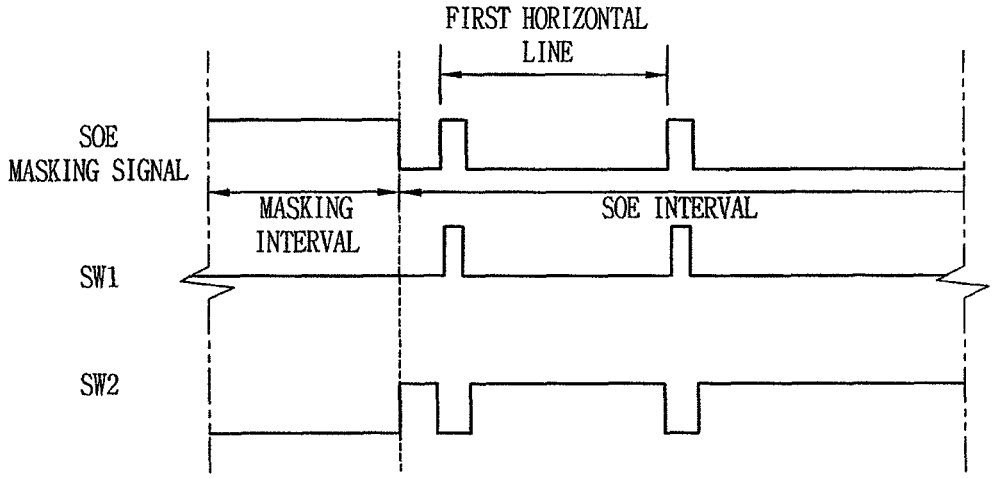
FIG. 5B illustrates a waveform showing a switching control signal applied to the data driver of FIG. 5A.

FIG. 5B illustrates a first switching signal and a second switching signal which are input to the first switch SW1 and the second switch SW2, respectively, at the time of the initial driving. As shown in FIG. 5B, the second switching signal maintains a low-state at the initial driving of the liquid crystal display device 100. Accordingly, the second switch SW2 maintains an off-state, and the unwanted initial data is not inputted to the m data lines which are connected to the second switch SW2.

As described above, since the second switch SW2 is turned off at the time of the initial driving of the liquid crystal display device 100, the initial data is not inputted to the liquid crystal panel. An interval to which the initial data is not inputted corresponds to a masking interval. Accordingly, the initial data which may be a certain gradation voltage or else, is not applied to the data line at the time of the initial driving of the liquid crystal display device. A display quality may improve by preventing deterioration of a screen quality, for example, a longitudinal line on a screen.

After the masking interval, a low signal is applied to the first switch SW1 thus to turn off the first switch SW1, and a high signal is applied to the second switch SW2 to turn on the second switch SW2. Accordingly, the picture signal in the form of an effective picture voltage is applied to the pixel of the liquid crystal panel 116, thereby displaying a picture. When a high signal is applied to the first switch SW1 to turn on the first switch SW1 and a low signal is applied to the second switch SW2 to turn off the second switch SW2, two adjacent output lines of each buffer 114*b* (FIG. 5A) are short-circuited with each other. As a result, an intermediate-level of the voltage of both lines is maintained. This may result in improving a response time by shortening a charge time of each pixel in response to a next picture data voltage.

Figure 6:
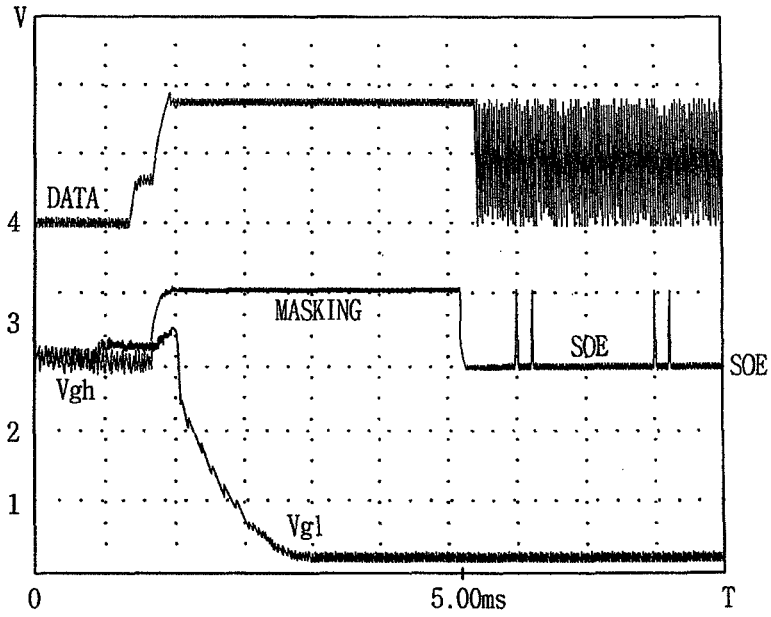
FIG. 6 illustrates a masking interval formed at the initial driving time of the liquid crystal display device of FIG. 2.

FIG. 6 illustrates one example of a waveform showing the state of a gate signal voltage, a data signal, and the SOE control signal at the time of the initial driving of a liquid crystal display device 100.

As shown in FIG. 6, when the gate high voltage (Vgh) is dropped to the gate low voltage (Vgl) at initial operation by turn-off of the gate voltage, the ideal gate voltage has the rectangular shape. However, in practical the tail is generated in the gate voltage in the tail interval (t) as shown in FIG. 6. By this tail, at the time of the initial driving of the liquid crystal display device, the TFT is turned on in the interval which is not set.

The masking interval is formed while the tail of the gate low voltage (Vgl) is present at the time of the initial driving. The masking interval covers the period that the tail of the gate low voltage (Vgl) is present and may ensures a complete turn-off of the TFTs receiving the gate law voltage (Vgl). Accordingly, the unwanted initial data may be inhibited from transferring to the data lines DL1-DLm. Switches of the output controlling unit 114*a* of the data driver 114, i.e., the second switch SW2 are synchronized to a rising edge of the masking interval and turned off for a certain time period. Accordingly, data output during the masking interval may be prevented, and a normal picture voltage is outputted from the data driver 114 by being synchronized to the SOE interval.

As described above, in this invention, the SOE masking signal is generated and applied, the pixel signal is not applied to the liquid crystal display panel at the time of the initial driving of the liquid crystal display device. Thus, at the time of the initial driving of the liquid crystal display device, it is possible to prevent the vertical line on the screen of the liquid crystal display device by the gray voltage applied to the data lines from the data driver.

Meanwhile, the present invention is not limited in the above structure. This invention is to prevent the deterioration of the image when the TFT is turn on in the period that the tail of the gate low voltage (Vgl) is present at the time of the initial driving. Therefore, if the deterioration of the image caused by the tail of the gate low voltage (Vgl) may be prevented, any structure can be adapted in the present invention.

Figure 7:
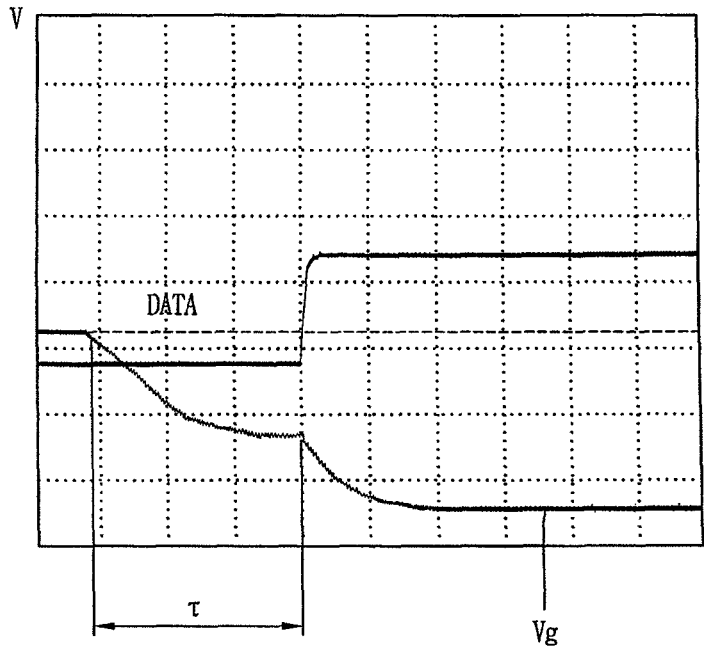
FIG. 7 is other waveform of the liquid crystal display device according to the present invention.

FIG. 7 is the waveform of other method of the present invention. As shown in FIG. 7, in this method, the gate voltage (Vg) is delayed in the certain interval ($\tau$) and thus the TFT is not turned on in the tail of the gate low voltage (Vgl). That is, the termination of the tail of the gate low voltage (Vgl) is synchronized to the input time of the effective data signal, so that the TFT is not turned on in the tail of the gate low voltage (Vgl)

The foregoing embodiments and advantages are merely exemplary and are not to be construed as limiting the present disclosure. The present teachings can be readily applied to other types of apparatus. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A method for driving a liquid crystal display device operable to display a picture represented at least by gradation voltage data using a liquid crystal panel, comprising:

supplying a gate control signal to control a gate driver;

supplying a data control signal to control a data driver, wherein the data driver includes a buffer and a switch for a data line of each liquid crystal cell, and the switch is disposed between and connected directly to an output of the buffer and the data line;

storing the gradation voltage data in the buffer before outputting the gradation voltage data to the data line;

controlling the switch to control output of the gradation voltage data from the buffer to the data line;

generating a source output enable ("SOE") signal, wherein the SOE signal enables transfer of the gradation voltage data corresponding to a first horizontal line from the data driver to the liquid crystal panel;

generating and counting a number of clocks;

comparing the number of clocks to a reference value, and outputting one of the SOE signal and an SOE masking signal to the data driver to turn on or off the switch based on a comparison between the number of clocks and the reference value, wherein when the clock count exceeds the reference value, the SOE signal is outputted and sent to the data driver to turn on the switch such that the gradation voltage data is output from the buffer to the liquid crystal panel, and when the clock count is less than the reference value, the SOE masking signal is outputted and sent to the data driver to turn off the switch to inhibit output of the gradation voltage data from the buffer of the data driver to the liquid crystal panel during a masking interval;

wherein the SOE masking signal has the masking interval corresponding a section of a tail of a gate voltage output from the gate driver at the time of initial driving;

wherein the tail is generated in the gate voltage when the gate high voltage is dropped to the gate low voltage at initial operation by turn-off of the gate voltage; and wherein the rising edge of the SOE masking signal is synchronized with a turn-off of the gate voltage.

2. The method of claim 1, wherein the output of the gradation voltage data is inhibited during an initial driving of the liquid crystal display device.

3. The method of claim 1, further comprising:

generating the SOE masking signal based on the SOE signal wherein the SOE masking signal is generated for a predetermined masking interval.

4. The method of claim 3, wherein generating the SOE masking signal comprises determining a time period for maintaining a high state of the SOE masking signal.

5. The method of claim 3, further comprising generating a SOE control signal that comprises the SOE masking signal during the initial driving of the liquid crystal panel and the SOE signal after the initial driving.

6. The method of claim 5, wherein generating the SOE control signal comprises generating the SOE control signal that performs an "OR" logic operation for the SOE signal and the SOE masking signal.

7. The method according to claim 1, wherein the switch is a second switch, further comprising a first switch that selectively connects adjacent data lines when the second switch is turned off.

8. The method of claim 1, further comprising applying a high signal to the switch of the data driver to turn on the switch after the masking interval, thereby supplying the gradation data voltage to the liquid crystal panel.

9. The method of claim 1, further comprising synchronizing the turn-off timing of the switch to a rising edge of the SOE masking signal.

10. A liquid crystal display device, comprising:

a liquid crystal panel comprising a plurality of liquid crystal cells, each liquid crystal cell defined by a gate line and a data line;

a timing controller which generates a gate control signal, a data control signal, a source output enable (SOE) signal, and a SOE masking signal for a predetermined masking interval based on the SOE signal, wherein the SOE signal enables transfer of a pixel signal to the data line and the SOE masking signal inhibits transfer of the pixel signal to the data line;

a gate driver which controls the thin film transistor connected to the gate line of each liquid crystal cell according to the gate control signal;

a data driver which includes a buffer that stores the pixel signal and an output controlling unit disposed between and directly connected to an output of the buffer and the data line, the output controlling unit controlling output of the pixel signal from the buffer to the data line of the each liquid crystal cell according to the data control signal, wherein the data driver does not output the pixel signal during the masking interval; and wherein a masking signal generating unit comprises;

an oscillator which generates clocks having a certain period;

a count unit operable to count a number of clocks generated by the oscillator; and a comparison unit operable to determine the high-state and the low-state of the SOE masking signal, wherein the high-state lasts until the clock count exceeds a reference value, wherein the output controlling unit of the data driver is in communication with the masking signal generating unit and controls the output of the pixel signal to the liquid crystal panel based on a comparison between the number of clocks and the reference value;

wherein the SOE masking signal has the masking interval corresponding a section of a tail of a gate voltage output from the gate driver at the time of initial driving;

wherein the tail is generated in the gate voltage when the gate high voltage is dropped to the gate low voltage at initial operation by turn-off of the gate voltage; and wherein the rising edge of the SOE masking signal is synchronized with turn-off of the gate voltage.

11. The device of claim 10, wherein the masking interval is formed at the time of an initial driving of the liquid crystal display device.

12. The device of claim 10, wherein the timing controller comprises the masking signal generating unit which determines a time period for a high-state and a low-state of the SOE masking signal based on a clock count.

13. The device of claim 10, wherein the data driver comprises a switch connected to the data line of the each liquid crystal cell and the switch is turned off according to the SOE masking signal from the timing controller during the masking interval.

14. The device of claim 13, wherein after the masking interval, the turn-on timing of the switch is synchronized with the SOE signal.

15. The device of claim 12, wherein the data driver comprises a first switch and a second switch, the first switch connecting two adjacent data lines and the second switch connected to the data line of the each liquid crystal cell.

16. The device of claim 15, further comprising a switch signal generating unit which outputs a switching signal for controlling the first switch and the second switch according to a SOE control signal including the SOE signal and the SOE masking signal.

17. A liquid crystal display device, comprising:

a liquid crystal panel comprising a plurality of liquid crystal cells, each liquid crystal cell defined by a gate line, a data line and a thin film transistor;

a gate driver which controls the thin film transistor connected to the gate line of each liquid crystal cell according to a gate control signal;

a data driver which outputs a pixel signal to the data line of the each liquid crystal cell according to a data control signal, wherein the data driver comprises a buffer that stores the pixel signal and a switch directly connected to an output of the buffer and the data line of the each liquid crystal cell, the switch controlling output of the pixel signal from the buffer to the data line;

an initial driving control unit in communication with the switch of the data driver, controlling the switch of the data driver, and structured to compare a clock count with a predetermined reference value and operable to alternately generate a SOE masking signal and a SOE signal based on the comparison, the initial driving control unit outputting SOE masking signal to the switch to turn off the switch during a masking interval whereby the pixel signal stored in the buffer is not output to the data line during the masking interval;

wherein the SOE masking signal has the masking interval corresponding a section of a tail of a gate voltage output from the gate driver at the time of initial driving;

wherein the tail is generated in the gate voltage when the gate high voltage is dropped to the gate low voltage at initial operation by turn-off of the gate voltage; and wherein the rising edge of the SOE masking signal is synchronized with turn-off of the gate voltage.

18. The device of claim 17, wherein the SOE control signal is provided to the data driver, wherein the SOE masking signal is provided to the data driver during an initial driving period and the SOE signal is provided to the data driver after the initial driving period.

* * * * *